United States Patent [19]

Bruni et al.

[11] Patent Number: 4,490,152

[45] **Date of Patent: * Dec. 25, 1984**

[54] TERNARY FUEL HAVING FAIRLY CONSTANT ACETYLENE CONTENT IN THE LIQUID AND VAPOR PHASE

[75] Inventors: Maurice Bruni, Tremblay-les-Gonesse; George Duboz, Paris, both of France

[73] Assignee: L'Air Liquide-Societe Anonyme pour l'Etude et l'Exploitation des Procedes Georges Claude, Paris, France

[ * ] Notice: The portion of the term of this patent subsequent to Jan. 17, 2001 has been disclaimed.

[21] Appl. No.: 352,345

[22] Filed: Feb. 25, 1982

[30] Foreign Application Priority Data

Mar. 16, 1981 [FR] France ..... 81 05207

[51] Int. Cl.[3] ..... C10L 1/00

[52] U.S. Cl. ..... 44/50; 44/52; 44/53; 48/197 FM

[58] Field of Search ..... 44/53, 52, 62, 50; 585/6; 48/196 FM, 197 FM, 199 FM

[56] References Cited

U.S. PATENT DOCUMENTS

| | | | |
|---|---|---|---|
| 1,096,797 | 5/1914 | Snelling | 44/52 |
| 1,528,765 | 3/1925 | Harris | 44/52 |
| 3,796,554 | 3/1974 | Meinass | 48/197 FM |
| 4,045,189 | 8/1977 | Bruni et al. | 48/197 FM |
| 4,426,207 | 1/1984 | Bruni et al. | 44/50 |

FOREIGN PATENT DOCUMENTS

| | | | |
|---|---|---|---|
| 2128925 | 10/1972 | France . | |
| 476342 | 12/1937 | United Kingdom | 44/52 |

OTHER PUBLICATIONS

Chem. Abstracts-vol. 84, No. 13, 6/28/76, p. 125, Abs. No. 182365n-Columbus, Ohio, JP-A-7609105 Nichigo Acetylene Co., Ltd.

*Primary Examiner*—William R. Dixon, Jr.
*Assistant Examiner*—Margaret B. Medley
*Attorney, Agent, or Firm*—Browdy and Neimark

[57] ABSTRACT

A fuel mixture, which contains by volume 15 to 25% acetylene, 5 to 17% $C_3$ hydrocarbon, preferably propylene, and the remainder ethylene. This ternary fuel having a fairly constant acetylene content, is suitable in applications pertaining to assembly, flame heat treatment, flame metal spraying and disintegration of inorganic compounds or cements.

5 Claims, 5 Drawing Figures

TERNARY FUEL HAVING FAIRLY CONSTANT ACETYLENE CONTENT IN THE LIQUID AND VAPOR PHASE

FIELD OF THE INVENTION

This invention relates to a ternary fuel having a fairly constant acetylene content in the liquid and vapor phases.

BACKGROUND OF THE INVENTION

It has been a practice, for more than a half century, to use acetylene as a fuel in this technical field. However, the physical and chemical nature of acetylene makes it very dangerous to keep it compressed in the natural state, and currently it is stored in a porous material after having been compressed and dissolved in a solvent, such as acetone. Under these conditions, the weight of acetylene stored or shipped is slight in relation to the weight of the container and its contents.

Shipping and storage of acetylene in the liquid state has been considered, but because of the risk of explosion and the difficulty in handling, pure liquified acetylene is not used.

Use of mixtures of acetylene has been proposed, thus avoiding the risks of explosion and making it possible to obtain a combustion temperature high enough to perform welding and oxygen cutting operations. On the other hand, it is known that addition of acetylene to a fuel gas can impart to the latter welding performances similar to those of acetylene. Now, although it is easy to make up gaseous mixtures having a constant composition, such is not the case when the mixture is stored in the liquid state where the gaseous phase is different, in chemical composition, from the liquid phase. In the case of an ethylene-acetylene mixture, an enrichment in acetylene content occurs, while in the case of a propylene-acetylene mixture there is an impoverishment in acetylene content, which after a certain time results in a mixture which is unsuitable for welding.

This difficulty can be avoided by removal of the liquid phase from the mixture, the content of which remains constant to the extent that the liquid is not heated at high temperatures or for long periods of time.

Generally, in industry, heating of the liquid cannot be avoided and it is necessary to relieve the excess pressure which creates a modification of the mixture content. This phenomenon is very important when insulation of the container is poor or when the cryogenic container is stored too long.

For several years an effort has been made to find combustible mixtures having a fairly constant acetylene content which do not require special equipment for its distribution as a liquid, as is the case for ethylene-acetylene mixtures.

Mixtures have been found that are distributable in liquid form using standard cyrogenic liquid equipment and the gaseous and liquid phases of which have a fairly constant acetylene content. These combustible gaseous mixtures, obtained by natural evaporation of the liquid phase, without removal of the latter, represent a saving in investment for the user because of a simplification of the equipment in relation to the use of binary ethylene-acetylene mixtures as fuels.

With known ethylene-acetylene mixtures, there is preferred evaporation of the ethylene compound and consequently the acetylene enrichment in content of the liquid phase occurs. Proposed ternary mixtures that do not exhibit acetylene enrichment in the liquid phase are less explosive and thus meet safety standards better.

SUMMARY AND OBJECTS OF THE INVENTION

Mixtures of two hydrocarbons and acetylene have been obtained which, by natural evaporation, result in a gaseous mixture, the acetylene content of which varies very slightly; therefore a standard cold evaporator may be used which permits simultaneous removal of the liquid and gaseous phases, thereby producing a three constituent mixture in which one constituent is more volatile than acetylene, while the third constituent is less volatile. This last constituent, by physical effect, contributes to the stabilization of the liquid phase content at the end of emptying of the container, while the more volatile constituent stabilizes the gaseous phase content at the beginning of emptying of the container.

This combination further increases the stability of the acetylene mixture which, in the gaseous phase, remains practically at constant acetylene content while its content in the liquid phase steadily decreases. The second constituent selected to be more volatile than acetylene is ethylene.

The third constituent selected to cause stabilization of the liquid phase is a hydrocarbon, the molecule of which contains three carbon atoms, said hydrocarbon belonging to the group comprising propane, cyclopropane and propylene; the choice of this third constituent is preferably the unsaturated hydrocarbon, namely propylene.

According to the invention, the ternary fuel having a fairly constant acetylene content in the liquid and vapor phases is made up of acetylene, ethylene and a hydrocarbon containing three carbon atoms in its molecule. This fuel preferably contains 15 to 25% by volume of acetylene, 5 to 17% by volume of a $C_3$ hydrocarbon and the remainder ethylene. The molar ratio of ethylene/$C_3$ hydrocarbon is preferably between 6 to 12.

DETAILED DESCRIPTION OF PREFERRED EMBODIMENTS

Figure 1:
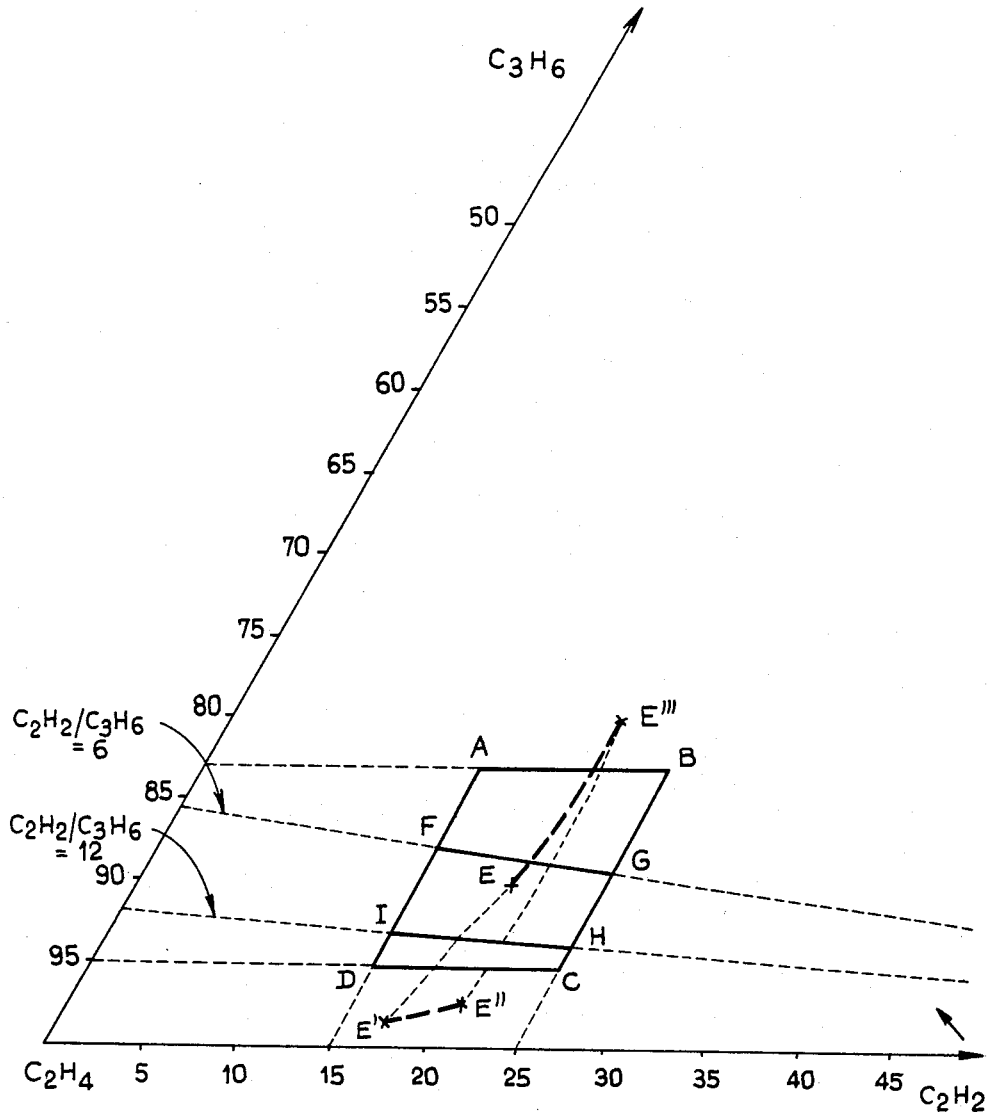
FIG. 1 is a ternary diagram of the fuel mixtures of the invention.

The fuel mixtures of the invention, when the $C_3$ hydrocarbon is propylene are represented in the attached ternary diagram in FIG. 1. The acetylene, ethylene and propylene contents are plotted in percentages by volume. The properties of constancy of acetylene content of the compositions are shown in the quadrilateral ABCD and more particularly in the quadrilateral FGHI limiting the ratio $C_2H_4/C_3H_6$ between 6 and 12.

The preferred range of use corresponds to a mixture containing about 20% by volume of acetylene, about 10% by volume of propylene and about 70% by volume of ethylene, represented by point E in quadrilateral ABCD. In FIG. 1, points E''' and E'' correspond respectively to the compositions of liquid phase E''' and gaseous phase E'' of mixture E at 70% of emptying; lines E-E''' represents the evolution of liquid phase E, line E'-E'' that of gaseous phase E; conjugate point E' corresponds to the composition of the gaseous phase in equilibrium with E.

The combustible ternary mixtures exhibit a very great storage flexibility; they can especially be stored in cryogenic containers, at temperatures between −80° and −60° C. and under a pressure of 3 to 6 bars.

These combustible mixtures the gaseous phase and liquid phase of which have a fairly constant acetylene content are distributable in liquid form using standard cryogenic liquid equipment, avoiding the use of metals the reactivity of which with acetylene is well known. Further, these mixtures cover a very great number of applications involving flame heat treatments. They are particularly suitable as fuels in applications of assembly, machining and flame heat treatment. The combustible ternary mixtures are also suitable for metal spraying with flame or disintegration of inorganic compounds or cements.

Some examples illustrating the invention in a nonlimiting way are given below.

EXAMPLE 1

Evaporation curve of a type 1 mixture the composition of which by volume of the initial liquid phase is:

| | |
|---|---|
| acetylene | 20.5% |
| propylene | 10.5% |
| ethylene | 69% |

Figure 2:
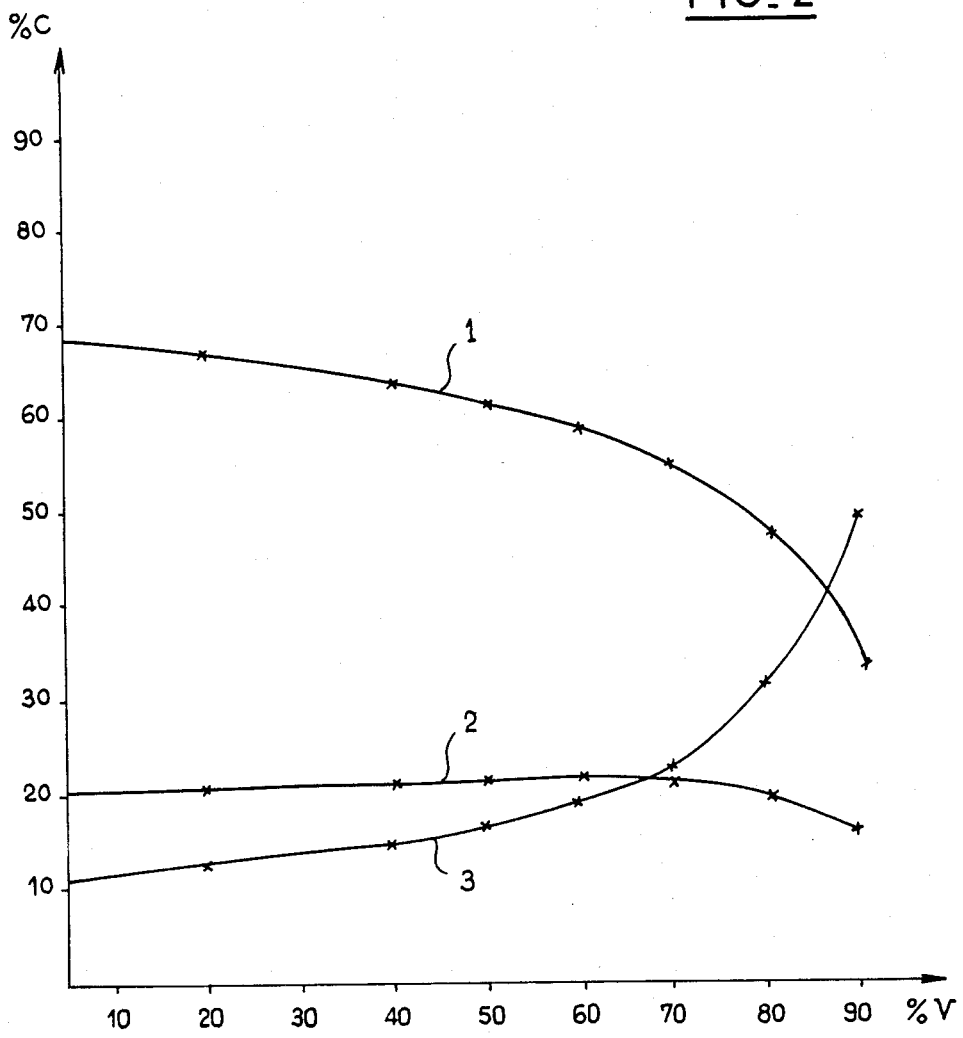
FIG. 2 is a graph showing the composition of the fuel mixtures in the liquid phase during emptying.
Figure 3:
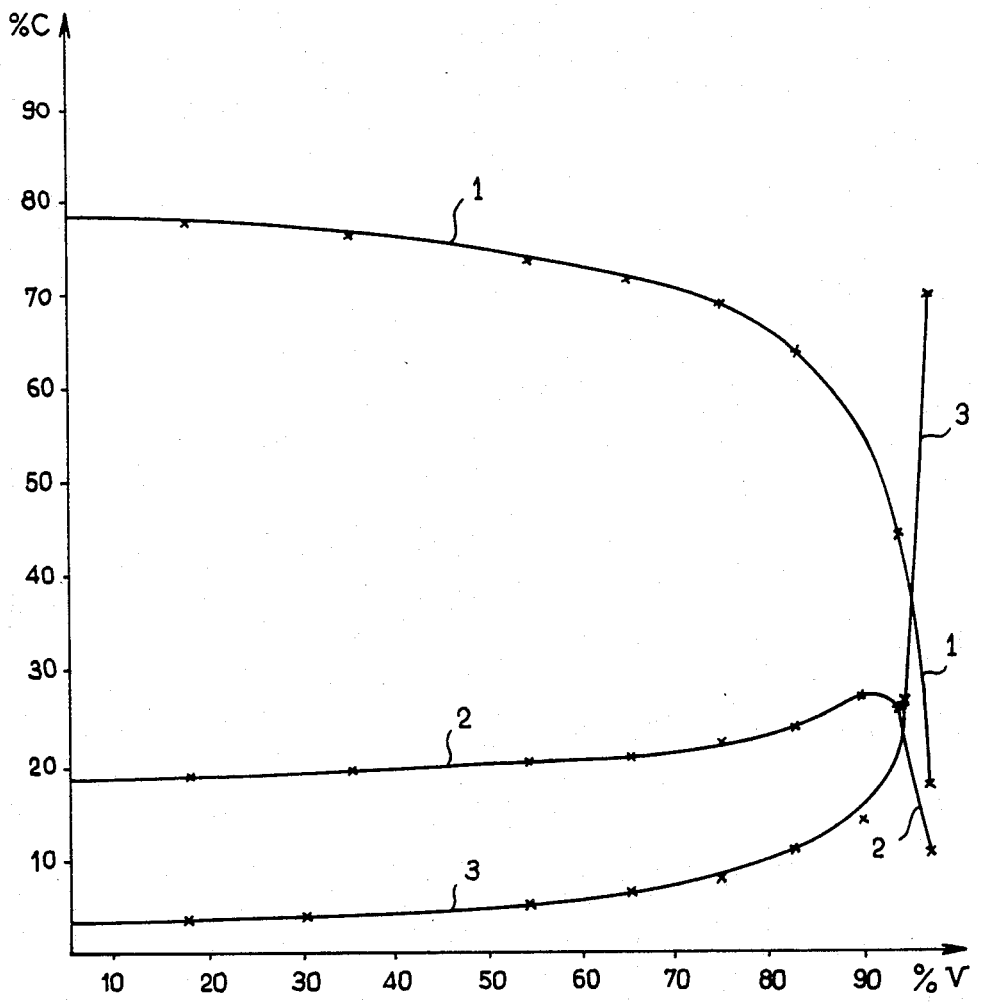
FIG. 3 is a graph showing the composition of the fuel mixture in the gaseous phase during emptying.

The variation of the composition of the liquid and gaseous phases during emptying of the cryogenic container by natural evaporation is respectively shown in attached FIGS. 2 and 3. The curves correspond to a pressure of 6 bars absolute prevailing in the container. The percentages of hydrocarbons, by volume at the initial moment, are plotted on the Y-axes (% C) and the percentages of emptying (% V) are plotted on the X-axes. Curve 1 corresponds to ethylene, curve 2 to acetylene and curve 3 to propylene.

FIG. 2 corresponds to the composition of the liquid phase during emptying and FIG. 3 corresponds to the variation of the composition of the gaseous phase during the same emptying operation.

EXAMPLE 2

Flame temperature. Mixtures 2 and 3 were made up, the compositions of which by volume of the initial liquid phases are:

| | Mixture 2 | Mixture 3 |
|---|---|---|
| acetylene | 22% | 20% |
| ethylene | 61% | 70% |
| propylene | 17% | 10% |

and a comparison was made with ethylene and the mixture of 20% acetylene and 80% ethylene, known under the trademark "Crylene".

Figure 4:
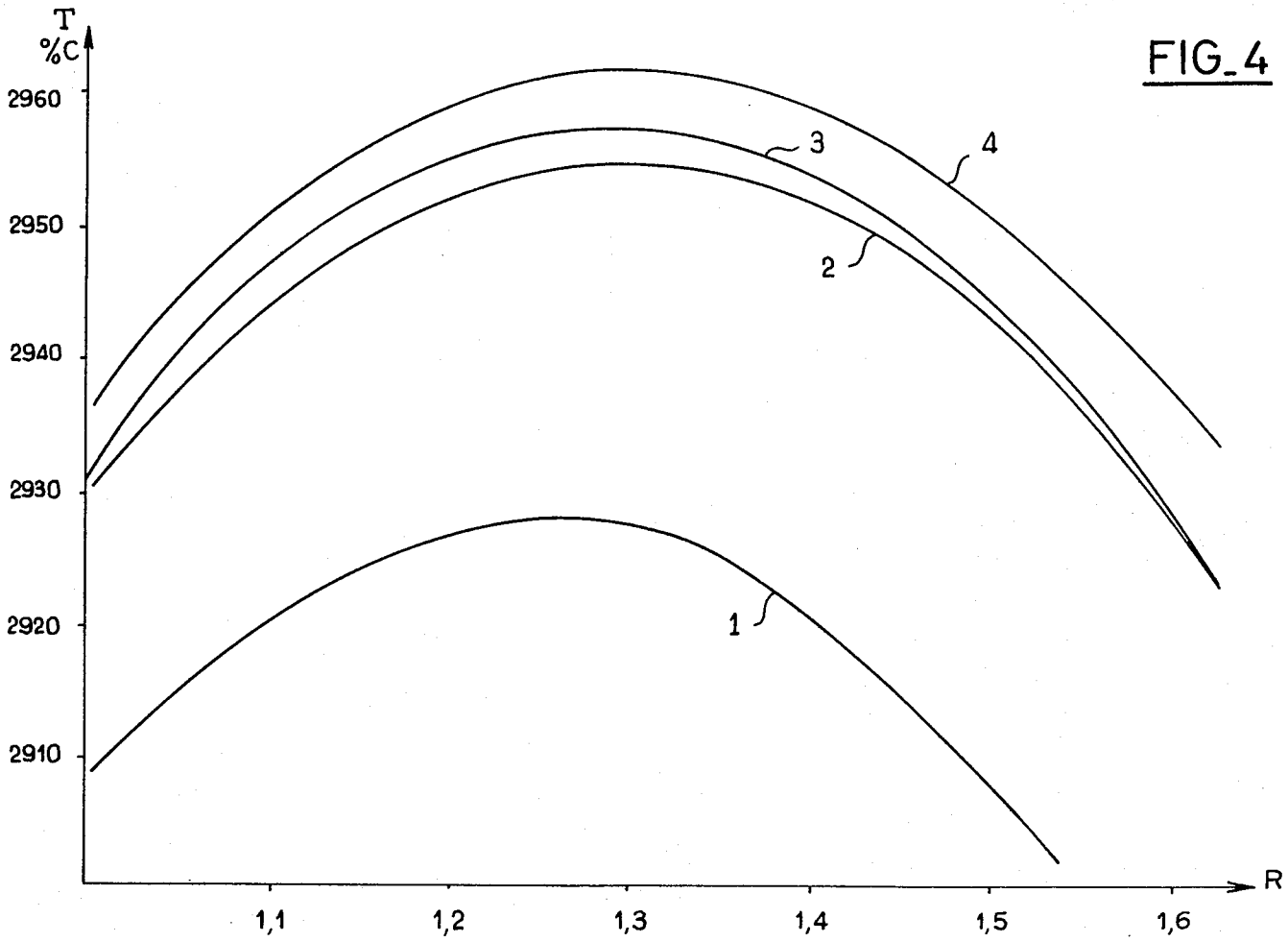
FIG. 4 is a graph showing the change in flame temperatures as a function of the richness of the fuel mixture.

FIG. 4 shows the evolution of the flame temperatures as a function of the richness (R) plotted on the X-axes, the maximum is observed for richnesses close to 1.3; the temperatures in degrees centigrade (T°C.) is plotted on the Y-axes.

It is seen that mixtures 2 and 3 exhibit temperatures close to "Crylene"; the mixtures of the invention form a group close to "Crylene".

The hottest flame is obtained with mixture 3 at 10% propylene (curve 3) at a temperature slightly higher than that of mixture 2 (curve 2) and slightly lower than that of "Crylene" (curve 4) and much above that of ethylene (curve 1).

EXAMPLE 3

Combustion Heat

Figure 5:
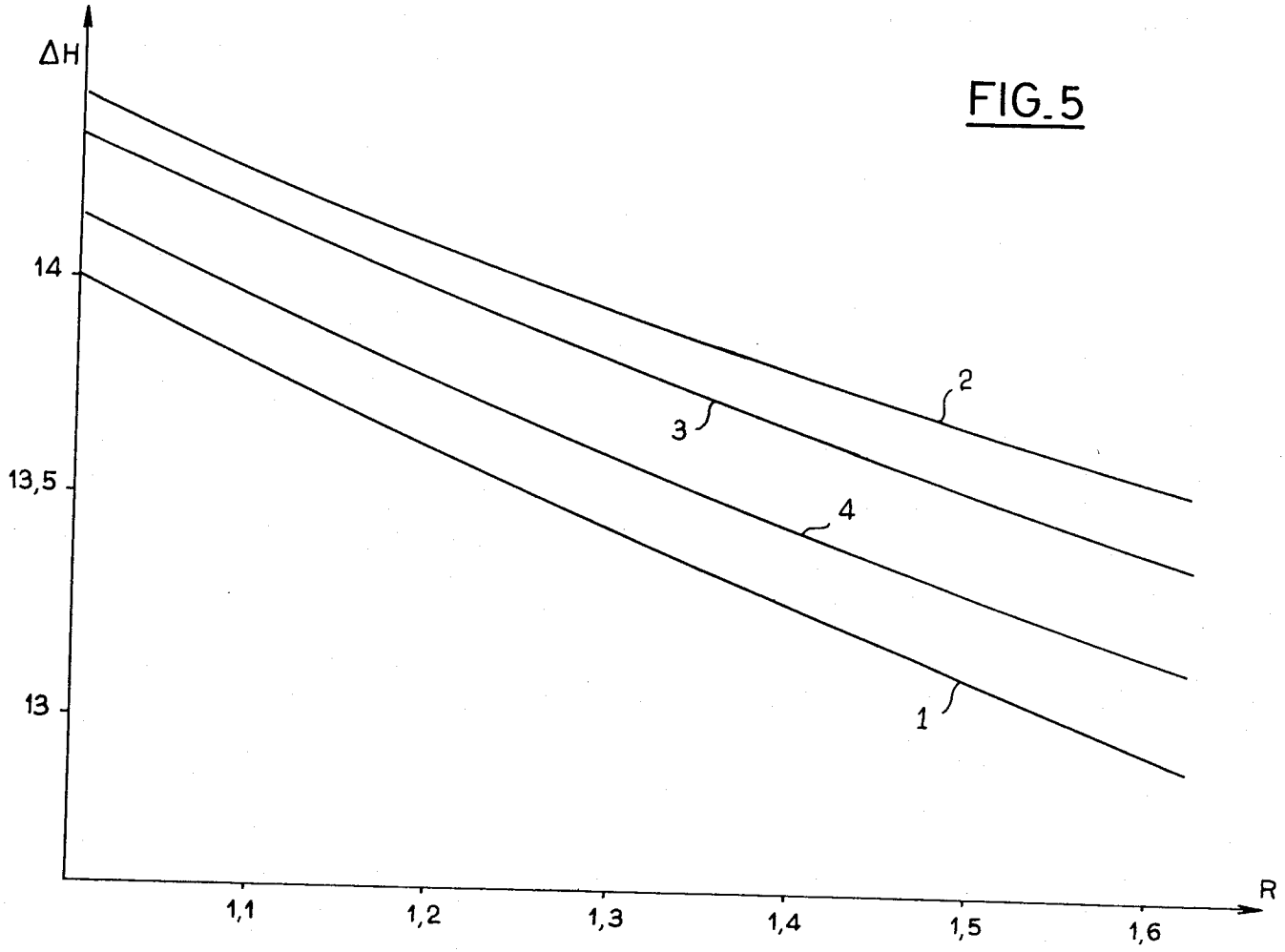
FIG. 5 is a graph showing combustion heat of various fuel mixtures as a function of the richness of these mixtures.

The combustion heat of mixtures 2 and 3, of ethylene and "Crylene" at 15° C. is expressed in joule per $m^3$ ($J/m^3$) of oxycombustible mixture. These heats for the four fuels are plotted on the Y-axes and the richness (R) on the X-axes in FIG. 5 of the attached drawing.

It can be seen that mixtures 2 (curve 2) and 3 (curve 3) perform better than "Crylene" (curve 4) and ethylene (curve 1). The following classification is obtained 2>3>"Crylene">ethylene.

We claim:

1. Ternary fuel mixtures having a fairly constant acetylene content in the liquid and vapor phases, consisting of a mixture of acetylene, ethylene and a hydrocarbon containing three carbon atoms in its molecule, wherein said mixture contains 15 to 25% by volume of acetylene, 5 to 17% by volume of the $C_3$ hydrocarbon and the remainder ethylene.

2. Ternary fuel according to claim 1, wherein the hydrocarbon containing three carbon atoms is selected from the group consisting of propane, cyclopropane and propylene.

3. Ternary fuel according to claim 1, wherein the $C_3$ hydrocarbon is propylene.

4. Ternary fuel according to any one of claims 1 to 3, wherein the molar ratio of ethylene/hydrocarbon having 3 carbon atoms is between 6 and 12.

5. Ternary fuel according to claim 4, wherein the mixture consists of about 20% by volume of acetylene, about 10% by volume of propylene and about 70% by volume of ethylene.

* * * * *